United States Patent [19]

James

[11] Patent Number: 4,531,320

[45] Date of Patent: Jul. 30, 1985

[54] QUICK-CHANGE PLASTIC STRIP DISPLAY BOARD

[76] Inventor: Houston F. James, 8350 Moberly, Dallas, Tex. 75227

[21] Appl. No.: 547,043

[22] Filed: Oct. 31, 1983

[51] Int. Cl.[3] ..... G09F 7/04

[52] U.S. Cl. ..... 40/621; 40/158 R; 40/622; 335/303

[58] Field of Search ..... 40/10 R, 489, 158, 621; 335/303

[56] References Cited

U.S. PATENT DOCUMENTS

| | | | |
|---|---|---|---|
| 2,298,081 | 10/1942 | Cohen | 40/622 |
| 2,518,204 | 8/1950 | Victor et al. | 40/621 |
| 2,600,505 | 6/1952 | Jones | 40/621 |
| 2,864,275 | 12/1958 | Fraleigh | 40/621 |
| 3,168,787 | 2/1965 | Surrey | 40/621 |
| 3,480,894 | 11/1969 | Joyce | 335/303 |
| 3,629,756 | 12/1971 | Holtz | 335/303 |
| 3,827,168 | 8/1974 | Mori | 40/621 |
| 4,242,823 | 1/1981 | Bruno | 40/621 |

FOREIGN PATENT DOCUMENTS

| | | | |
|---|---|---|---|
| 441978 | 1/1968 | Switzerland | 40/621 J |

*Primary Examiner*—Gene Mancene
*Assistant Examiner*—Wenceslao J. Contreras
*Attorney, Agent, or Firm*—T. D. Copeland

[57] ABSTRACT

A display board for displaying a menu of daily fare for restaurants, post exchanges, and the like, wherein the items listed for sale are printed on a long thin flexible plastic strip located in tracks that extend substantially the full width of the display board. The prices for the items listed are printed on a much shorter plastic strip which may be changed instantly and independently of the item strip. Both strips include a smaller width strip of iron ink on their back side, so that both strips are held in place by the same flexible magnetic source strip that is imbedded in the display board in parallel fashion to the display board tracks wherein the plastic strips reside. A clear plastic cover is locked in place over the finished menu to retain the displayed menu and prices until a change in fare is desired, at which time this cover is instantly removable.

12 Claims, 9 Drawing Figures

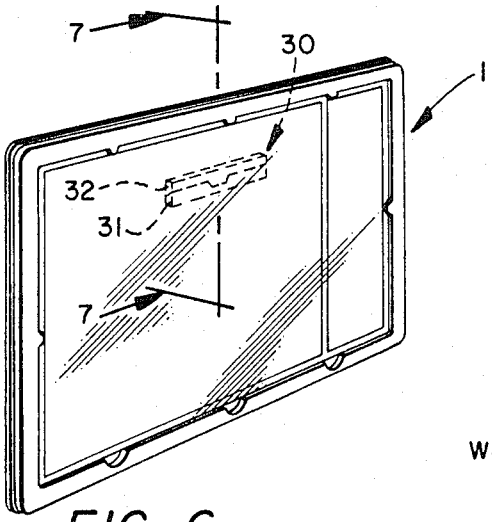
FIG. 6
FIG. 7
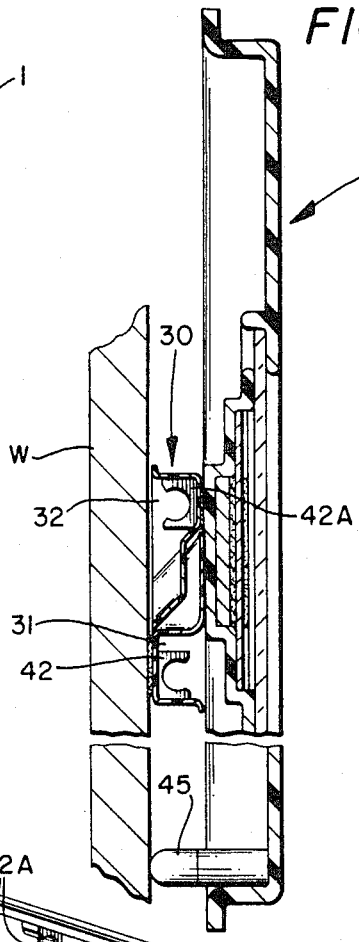
FIG. 8
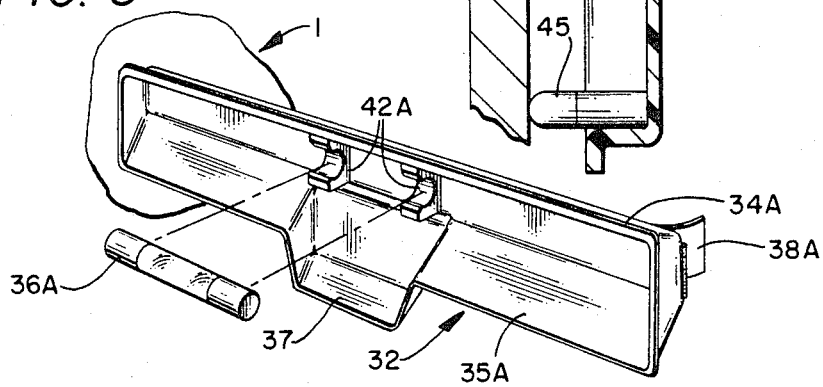
FIG. 9
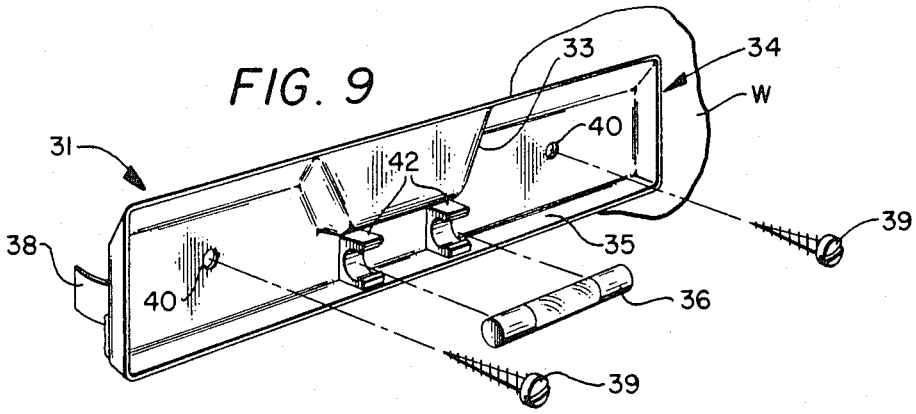

QUICK-CHANGE PLASTIC STRIP DISPLAY BOARD

This product application is copending with a design application filed on the same date entitled DESIGN FOR DISPLAY BOARD, and with both a product and a design application filed this date for WALL POSITIONING DEVICE, all by the instant inventor, all of which applications named are incorporated herein by reference.

BACKGROUND OF THE INVENTION (1) Field of Use: Wherever there is a need for a display board having quickly replaceable display characters.

(2) Prior Art: The following patents are known to exist in this or related fields:

U.S. Pat. No. 1,879,002, was issued to C. C. Alles on Sept. 27, 1932, for a Movable Magnetic Marker arrangement for use in visibly displaying musical notes and symbols on a sheet of continuous iron cross-section containing a musical staff and scale illustration thereon.

U.S. Pat. No. 2,600,505 was issued to M. H. Jones on June 17, 1952, for a Layout Board for Photographic Reproduction, which employs several vertically extending channels of back to back multiple horseshoe bar magnets overlaid by an adhesive backed paper that provides a mounting base for want-ads printed on the top side of a paper having an iron dust coating on the back side.

U.S. Pat. No. 2,825,160 was granted to A. R. Mellor on Mar. 4, 1958, for a Menu Holder and Magnetic Support Means Therefor. This patent discloses a magnetic arrangement for holding an entire menu folder.

U.S. Pat. No. 3,093,919 issued to H. J. Holtz on June 18, 1963, for a Magnetic Display Arrangement, that comprises a non-magnetic layer having an adhesive backing engaging a magnet of the same size for a visible game board. The game pieces are non-magnetic with a magnetizable bottom layer of varnish and powdered iron, or alternately, an iron foil.

U.S. Pat. No. 3,122,684 granted on Feb. 25, 1964, to R. I. Genin, for Magnetized Game Board Configurations. This patent discloses a technique for making and hanging signs by implanting short length magnetic bar pieces (taken from a longer breakaway bar) into the back side of the characters to be displayed.

U.S. Pat. No. 3,168,787 was issued to M. Surrey on Feb. 9, 1965, for a Display Board, that utilizes spaced apart magnet elements that engage grooves in a backing structure to magnetically support a plurality of individual panels that each hold their display items between cooperating lips in a non-magnetic retention.

U.S. Pat. No. 4,366,637 was granted Jan. 4, 1983 to D. V. Dechanmps for a Set of Advertising Components, namely characters of a magnetic rubber-like material having a film of anti-adhesive varnish on one side and a protective coat of vinyl on the other side to support a printed silk screen layer thereon. These characters will thus adher to a steel panel or filing notebook having steel sheets therein.

SUMMARY OF THE INVENTION

This invention relates to a display board for displaying a number of items in menu fashion, wherein the items listed in the left-most column on this board, are the names of the food items or merchandize being sold.

The items in the right-most column on this board are the current prices quoted for the items listed. Since the food items listed are constant over long periods of time, these are permanently imprinted on or into the top surface of the long plastic strips before such strips are placed into their proper track in the display boards. However, since the current prices are subject to frequent change, this item is not permanently imprinted on the same plastic strip as the food item, but rather is printed on a stub strip, that is only a fraction of its length. This construction permits almost instantaneous removal and replacement of the food item strip, and an even faster replacement of the price item strip. Both types of strips are equally easily removable by one's fingernails of a penknife, or the like.

BRIEF DESCRIPTION OF THE DRAWINGS

FIG. 6 is a perspective view of one embodiment of one mounting arrangement suitable for use in aligning and installing this display board onto a wall.

FIG. 7 is a cross-sectional view taken along the lines 7—7 of FIG. 6, and showing the matched set of hanger mounting pieces used for the installation shown in FIG. 6.

FIG. 8 is a detail perspective view of the hanger mounting piece, of the set shown in FIG. 7, that is attached to the display board.

FIG. 9 is a detail perspective view of the hanger mounting piece, of the set shown in FIG. 7, that is attached to the wall.

DESCRIPTION OF THE PREFERRED EMBODIMENTS

Figure 1:
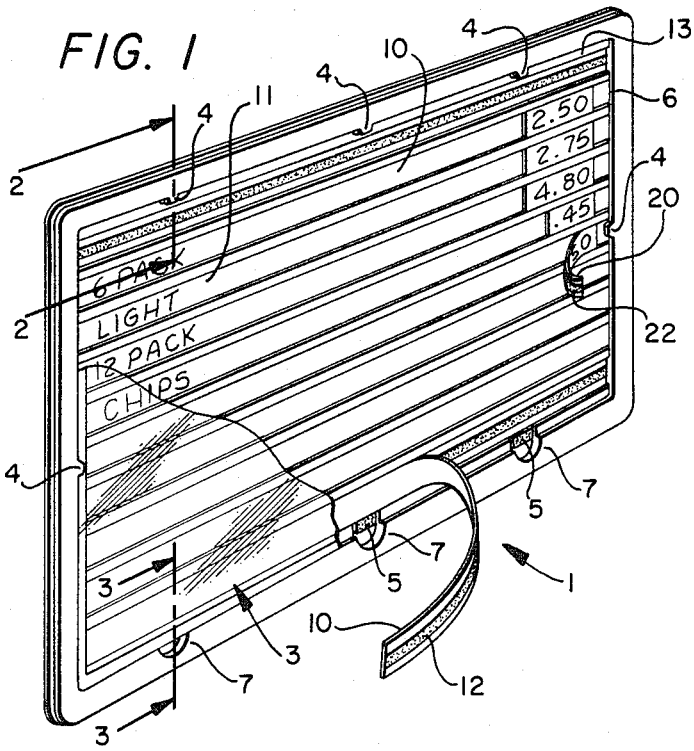
FIG. 1 is a perspective view of the display board assembly of this invention with its front cover panel removed for clarity of illustration.
Figure 5:
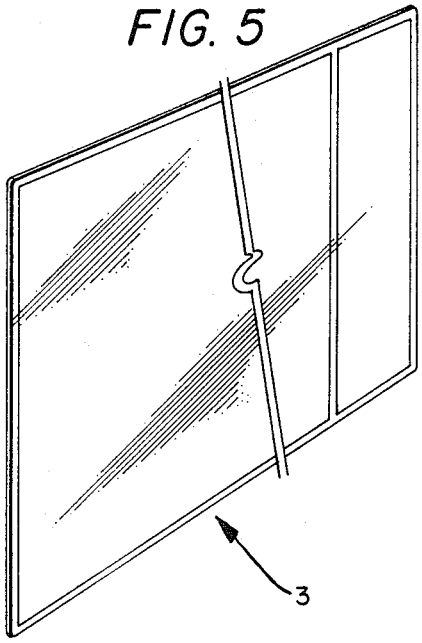
FIG. 5 is a fragmentary plan view of the front cover panel for the display board of FIG. 1.
Figure 2:
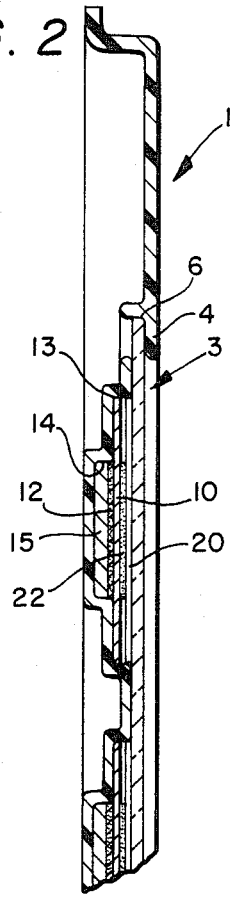
FIG. 2 is a cross-sectional view taken along the lines 2—2 of FIG. 1, with strips 10 and 20 and cover panel 3 reinserted.
Figure 3:
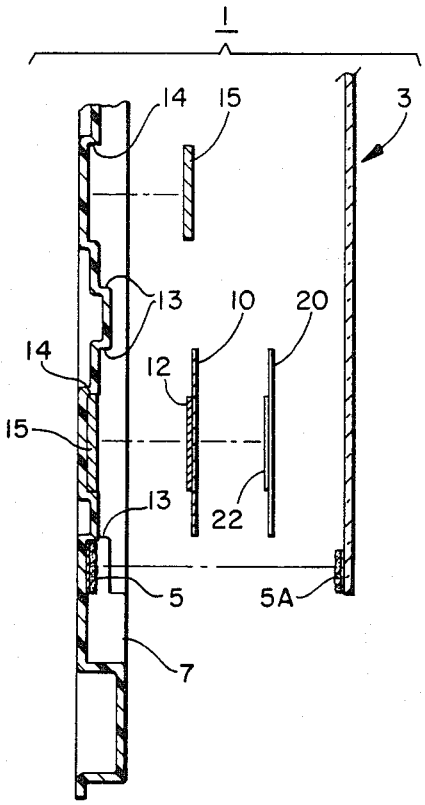
FIG. 3 is a cross-sectional view taken along the lines 3—3 of FIG. 1, showing some of the parts in exploded convention.
Figure 4:
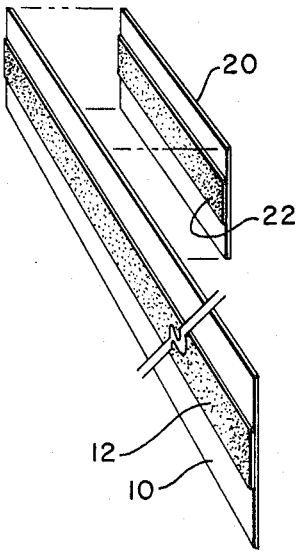
FIG. 4 is a perspective view of the two types of plastic strips employed with the display board of this invention.

Referring now more particularly to the characters of reference in the drawing, it will be observed that in FIG. 1, the display board 2 of display assembly 1, is shown without its clear plastic protective cover panel 3 (shown in FIGS. 3 and 5), but showing its intended location, i.e., over the listings of display items and prices, and held in place under tabs 4 at the top of board 2, and overlaying velcro pads 5 at the bottom of board 2. The board 2 is recessed at 6 to a depth, at least equal to the thickness of cover panel 3, to permit ease of installation of cover panel 3, and ease of cleaning the front of the display board panel after installation. The velcro pads 5 are installed by glueing them into the enlarged recessed pits 7, so that when panel pads 5 are installed, their matching pads 5A on the lower inside of panel 3 align with and engage pads 5 in such a manner as to maintain panel 3 within the recess 6 of board 2.

The long thin flexible plastic strips 10 include the items 11 that are listed for sale on this display board assembly 1. These strips are opaque and include the names of items 11 in a contrasting color or shade near the left end of the strips 10. The back side of each strip 10 includes a smaller width stripe 12 of iron ink that runs parallel to and for the full length of strip 10. A series of recessed tracks 13 permit installation of strips 10 on the display face of board 2. The ends of strips 10 terminate short of the ends of tracks 13, as indicated at 6A, to permit ease of removal ov strips 10 from their respective tracks 13, by using one's fingernails or pocket knife. A second series of recessed tracks 14 are included within tracks 13 for the purpose of retaining a flexible magnetic source stripe 15 for substantially the full length of tracks 13 and 14. A much shorter length strip 20 contains price information items 21 on its front side and also includes an iron ink stripe 22 completely across its back side. When the flexible magnetic source stripes 15 are glued in, or otherwise retained in their respective tracks 14, the tracks 13 are then ready to receive strips 10 and 20 in snug fitting relation. The iron ink stripes 12 and 22 on the back side of strips 10 and 20 respectively, line up with the magnetic source stripes 15, so that the information of items 11 and 21 may be securely displayed for as long a period as desired due to the holding power of the magnetic interaction of stripes 15, 12 and 22. Uniquely, the same holding power is present thru the thickness of strip 10, so that strip 20 is also held in place by source 15, even tho there is no direct contact between stripe 22 and its magnetizable source 15, and even tho strip 10 is interposed in between stripe 22 and source 15.

When the display board assembly 1 has been filled with the desired items for display, and the clear plastic transparent cover panel 3 has been installed, the assembly may be hung from a wall or other support by a unique mounting set 30, comprising a wall mounting fixture 31, and a board mounting fixture 32, as seen in FIGS. 6–9. The wall mounting fixture 31 is seen to comprise a moulded plastic member of relatively thin walls that includes a centrally located pocket 33, and a short dimension peripheral flange 34 including a bottom ledge 35 that provides partial support for mounting clips 42 to receive a very small spirit level 36. The board mounted fixture 32 is constructed similarly to fixture 31, but includes instead a centrally located tab 37 that extends downward from the fixture 32, and is of corresponding dimensions to those of pocket 33. Fixture 32 also includes a peripheral flange 34A including a top ledge that provides partial support for the clips 42A that hold a second small spirit level 36A. Each fixture 31 and 32 may include an adhesive tape 38/38A across its back side, or may include screw holes 40 to receive screws 39 to permit these fixtures to be mounted to the wall and display board respectively. Once the spirit level of each fixture is installed in its slightly flexible clip, and shows its fixture to be level, the fixture is then mounted at that position. Thereafter, regardless of the number of times the display board assembly 1 is removed from the wall W, it may be remounted in its established level position without further adjustment or alignment. It should be noted that the spirit levels are so mounted that they do not interfere with the cooperative engagement of the fixtures 31 and 32 nor of the attachment of those fixtures to the wall or display assembly, hence, one or both of the spirit levels may remain in their installed position. However, since only one spirit level can be used at a time by a single installer, it may be economical to include only one spirit level per installation packet. In this instance, the installer would mount one part, say fixture 31, and after its installation on the wall W, move the spirit level 36 to fixture 32, and after its installation on the display board, simply leave it in place in its clips 42A, or discard it, as desired.

The methods and structures disclosed and illustrated herein are representative of, but not limiting to the scope of the invention, as defined in the following claims, and including equivalents hereto.

What is claimed is:

1. A display assembly combination for mounting on a support and displaying a menu of items, comprising:

a. a display board defining a series of horizontal parallel recessed tracks thereon, b. a second series of horizontal tracks within the confines of the first named tracks, c. a plurality of thin flexible strips containing item names thereon and adapted to engage in said first named tracks, d. a plurality of thin flexible magnetic source stripes adapted to engage in said second named tracks, e. an additional plurality of much shorter thin flexible strips adapted to overlay and engage said first named flexible strips and containing item prices thereon, f. a stripe of iron ink centrally located on the back side of each strip and running parallel to said strip for the length thereof, g. means to conveniently install and remove each strip from its track, wherein said iron ink stripes coincide operationally with said magnetic stripe when all parts are installed, and h. transparent cover means to overlay all said strips and all tracks, i. and means in said display board assembly to quickly install and remove said cover means, and all item and price strips.

2. A display board assembly as in claim 1, including self-aligning mounting means between said display board and said support.

3. A display board assembly as in claim 1, wherein said first series of adjacent tracks are separated by a thin horizontal member that provides underlining for said item names and item prices.

4. A display board assembly as in claim 3 wherein said cover means includes at least one vertical line that separates data on said board when said cover means is installed.

5. A display board assembly as in claim 1, wherein said means to conveniently install and remove each strip from its track member includes a defined opening between the end of said strip and the nearest edge of the display board; said opening being sufficient to permit the operator's fingernail to enter and lift said strip from said track.

6. A display board assembly as in claim 5, wherein said cover means includes a wide line at each horizontal end thereof to overlay said defined openings to cover said openings from the observer's view.

7. A display board assembly as in claim 1 wherein said display board includes projecting tabs on one horizontal surface to receive one horizontal edge of said cover means, and includes a velcro well at the other horizontal surface to receive a cooperating velcro pad on said cover means to secure said cover means in place.

8. A display board assembly as in claim 1 wherein said display board is comprised of a single piece of a thin cross-section, semi-flexible plastic material and wherein each track is formed in and is part of said single piece material.

9. A display board assembly as in claim 8, wherein said cover means is formed from a single piece of clear plastic material having a much thicker cross section than said display board so that said cover means acts to stabilize and strengthen said flexible material display board when installed thereon.

10. A display board assembly as in claim 7, wherein said velcro well extends below said installed cover means at least a sufficient distance to permit an operator's finger to be inserted therein sufficiently to permit disengagement of said velcro pad from said velcro well and removal of said cover means from said display board.

11. A display board as in claim 1, wherein said stripe of iron ink on the back side of each shorter strip aligns horizontally with said iron ink stripe on said first named strip.

12. A display board as in claim 1, including support means for suspending said board from a wall in a precise horizontal attitude, and including means for suspending said board from a wall in a precise vertical attitude.

* * * * *